US007599651B2

(12) United States Patent
Kitagawa et al.

(10) Patent No.: US 7,599,651 B2
(45) Date of Patent: Oct. 6, 2009

(54) IMAGE FORMING APPARATUS INCLUDING GROOVED CAM AND LINK MECHANISM ENGAGING WITH GROOVES OF THE GROOVED CAM

(75) Inventors: Masaharu Kitagawa, Mishima (JP); Kenichiro Shishikura, Numazu (JP); Satoshi Kaiho, Yokohama (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 239 days.

(21) Appl. No.: 11/676,558

(22) Filed: Feb. 20, 2007

(65) Prior Publication Data

US 2007/0196141 A1 Aug. 23, 2007

(30) Foreign Application Priority Data

Feb. 20, 2006 (JP) ..... 2006-042768

(51) Int. Cl.
*G03G 15/01* (2006.01)

(52) U.S. Cl. ..... 399/302; 399/299; 399/313

(58) Field of Classification Search ..... 399/299, 399/302

See application file for complete search history.

(56) References Cited

U.S. PATENT DOCUMENTS 6,041,206 A * 3/2000 Park ..... 399/249

2003/0223785 A1* 12/2003 Kanekura et al. ..... 399/299

FOREIGN PATENT DOCUMENTS

| | | |
|---|---|---|
| JP | 2004-117499 | 4/2004 |
| JP | 2005-091725 | 4/2005 |

* cited by examiner

*Primary Examiner*—David M Gray
*Assistant Examiner*—Billy J Lactaoen
(74) *Attorney, Agent, or Firm*—Turocy & Watson, LLP

(57) ABSTRACT

An image forming apparatus has: an intermediate transfer member to which a toner image developed on a photosensitive material is transferred while the intermediate transfer member rotates plural times; a transfer roller that is provided to be able to move into contact with and apart from the intermediate transfer member and transfers the toner image on the intermediate transfer member to a paper sheet while conveying the paper sheet pressed to the intermediate transfer member; a grooved cam having different grooves formed respectively in front and back surfaces of the grooved cam. A link mechanism for color image printing and a link mechanism for monochrome printing are reciprocated independently from each other, with ends of the link mechanism engaged respectively in the grooves of the grooved cam, thereby to control contact and separation of the transfer roller and the intermediate transfer member.

5 Claims, 7 Drawing Sheets

IMAGE FORMING APPARATUS INCLUDING GROOVED CAM AND LINK MECHANISM ENGAGING WITH GROOVES OF THE GROOVED CAM

CROSS REFERENCE TO RELATED APPLICATIONS

This application is based on and claims the benefit of priority from the prior Japanese Patent Application No. 2006-042768, filed on Feb. 20, 2006, the entire content of which is incorporated herein by reference.

BACKGROUND OF THE INVENTION

1. Field of the Invention

The present invention relates to an image forming apparatus, and more particularly to an image forming apparatus in which a transfer device has an improved separation/contact mechanism.

2. Description of the Related Art

A tandem type image forming apparatus is known as a kind of image forming apparatus such as a copier or printer. In the tandem type image forming apparatus, toner images are formed respectively on plural photosensitive drums arranged in parallel. The toner images are transferred to a paper sheet with the toner images multi-layered on the paper sheet, to form a color image. Even though plural photosensitive drums are provided in such a tandem type image forming apparatus, the whole image forming apparatus is demanded to be compact in recent years. An image forming apparatus has a quadruple tandem type image forming mechanism capable of printing color and monochrome images and employs an intermediate transfer belt. In this image forming apparatus, transfer drums to be rotated are selectively switched between a case of printing a color image and another case of printing a monochrome image from the perspective of extending lifetime of the apparatus. When printing a monochrome image, only one transfer drum for monochrome images is rotated, and transfer drums for color images are stopped. In this case, the intermediate transfer belt is obviously rotated, therefore the intermediate transfer belt and the transfer drums not rotated are maintained apart from each other. At this time, corresponding primary transfer rollers and the belt are also maintained apart from each other. During a standby period for printing, all the transfer drums and the belt are maintained apart from each other so as to prevent deformation of the primary transfer rollers which use sponges as materials. According to known techniques, the whole belt unit is moved in order to move the transfer drums into contact with and a part from a belt, and a large-scale mechanism is hence required.

There have been several proposals concerning contact/separation between transfer drums and an intermediate transfer belt. For example, there has been proposed a separation mechanism for a transfer device which steadily operates and prevents noise and vibration (for example, see Jpn. Pat. Appln. Laid-Open Publication No. 2004-117499). This mechanism relates to a transfer device in which a sheet transfer roller as a transfer member is moved into contact with and apart from an intermediate transfer belt. The transfer device has a cam mechanism for moving the sheet transfer roller into contact with and apart from the intermediate transfer belt. When a small diameter side of a contact/separation cam faces the sheet transfer roller, the sheet transfer roller is moved so as to make contact with the intermediate transfer belt. A cam shaft is applied with a heavier load than torque which the cam shaft receives due to stress acting on the contact/separation cam when the sheet transfer roller makes contact with the intermediate transfer belt.

There has also been a proposal to relax an impact which occurs when a transfer roller makes contact (for example, see Jpn. Pat. Appln. Laid-Open Publication No. 2005-91725). According to this proposal, an image forming apparatus has an intermediate transfer member and a transfer roller. A toner image formed on a photosensitive member is transferred to the intermediate transfer member while the intermediate transfer member rotates plural times. The transfer roller is provided to be able to freely move into contact with and apart from the intermediate transfer member. The transfer roller transfers the toner image on the intermediate transfer member to a sheet material while conveying the sheet material pressed against to the intermediate transfer member by the transfer roller. The image forming apparatus further has an axle provided to be rotatable, two cams provided on the axle, and push arms respectively having ends in contact with the cams and other ends in contact with rotation bearings located at ends of the transfer roller. Phases of the two cams are shifted relative to each other so that timing when the transfer roller transits from a separate state of being separate from the intermediate transfer member to a contact state comes earlier at one end of the transfer roller in the lengthwise direction of the roller than at the other end of the transfer roller.

In known contact/separation mechanisms, the whole belt unit is moved to make contact to and separate from transfer drums. Consequently, a large-scale mechanism is required.

In addition, since the whole belt unit is moved, a high output motor, a large-scale contact/separation mechanism, and the like are necessary. Furthermore, since such a large unit is moved into contact with and separate from transfer drums, contact impact affected on the transfer drums is strong. As a result, the transfer drums are damaged, e.g., abraded due to repetitive impact if the image forming apparatus is used for a long time.

BRIEF SUMMARY OF THE INVENTION

It is an object of the present invention to provide an image forming apparatus which relaxes impact during contact/separation operation of a transfer mechanism.

In an aspect of the present invention, there is provided an image forming apparatus having an intermediate transfer member to which a toner image developed on a photosensitive material is transferred while the intermediate transfer member rotates plural times, and a transfer roller that is provided to be able to move into contact with and apart from the intermediate transfer member and transfers the toner image on the intermediate transfer member to a paper sheet while conveying the paper sheet pressed to the intermediate transfer member, the apparatus comprising a grooved cam having different grooves formed respectively in front and back surfaces of the grooved cam, wherein a link mechanism for color image printing and a link mechanism for monochrome printing are reciprocated independently from each other, with ends of the link mechanism engaged respectively in the grooves of the grooved cam, thereby to control contact and separation between the transfer roller and the intermediate transfer member.

DETAILED DESCRIPTION OF THE INVENTION

Figure 1:
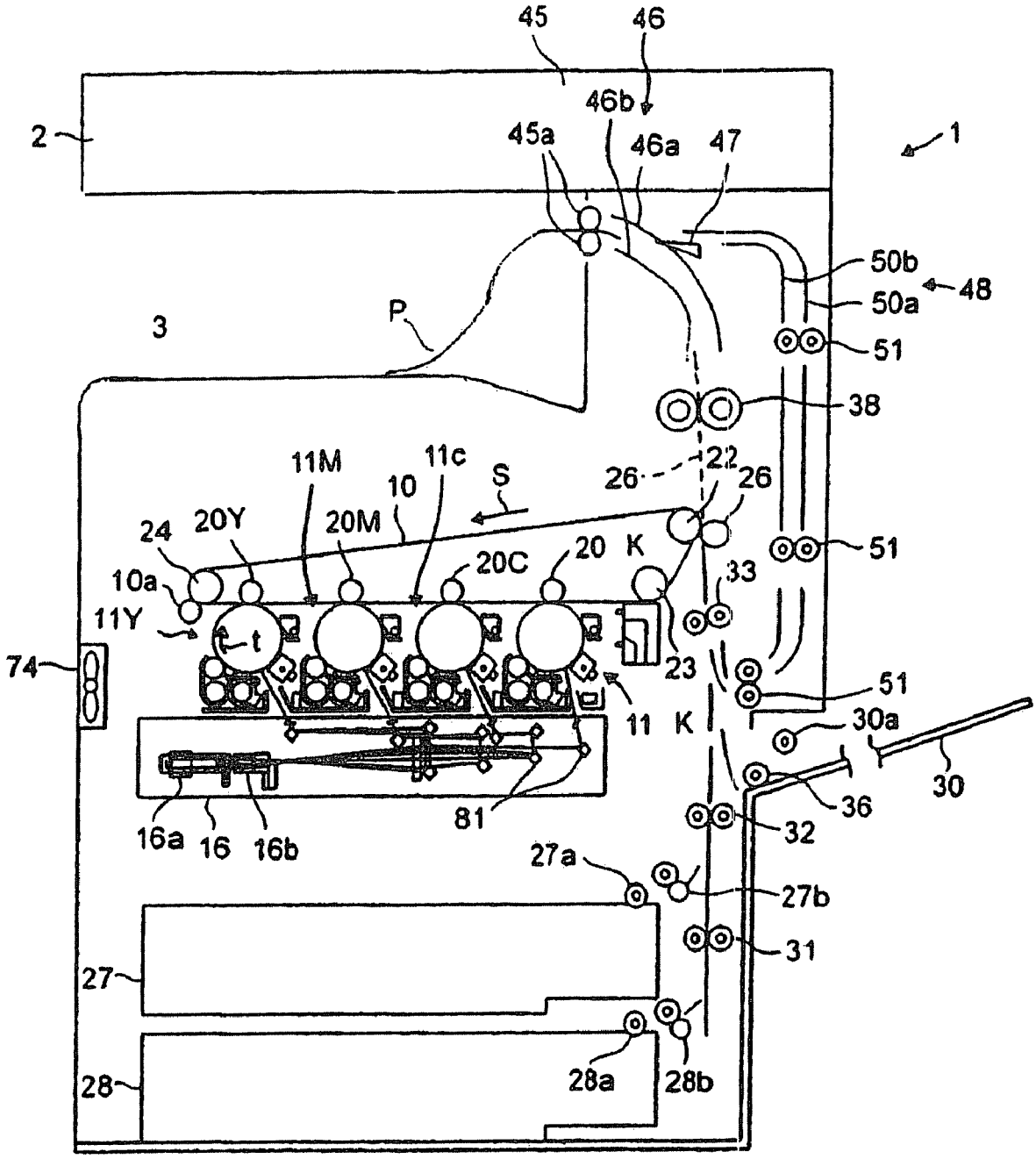
FIG. 1 shows a schematic structure of a color copier according to an embodiment of the invention.

Throughout this description, the embodiments and examples shown should be considered as exemplars, rather than limitations on the apparatus of the present invention.

An embodiment of the invention will now be described in detail with reference to the drawings. In the drawings, common parts will be denoted at common reference symbols, and reiterative descriptions thereof will be omitted.

FIG. 1 shows a schematic structure of a quadruple tandem type color copier 1 as an image forming apparatus according to an embodiment of the invention. As shown in FIG. 1, the color copier 1 has a scanner section 2 and an inner sheet delivery section 3 in an upper part of the copier. The color copier 1 has four sets of image forming sections 11K to 11C which are arranged in parallel along the lower side of an intermediate transfer belt 10 as an intermediate transfer medium.

The image forming sections 11K to 11C respectively have photosensitive drums 12K to 12C an image bearing member. The intermediate transfer belt 10 is made of, for example, semiconductive polyimide which is a stable material in view of heat resistance and abrasion resistance. The intermediate transfer belt 10 is suspended between a drive roller 22 and driven rollers 23 and 24. Above the image forming sections 11K to 11C, the intermediate transfer belt 10 faces and makes contact with the photosensitive drums 12K to 12C. At primary positions on the intermediate transfer belt 10 where the belt faces the photosensitive drums 12K to 12C, a primary transfer voltage of about +1,000 V is applied by primary transfer rollers 20K to 20C, so that toner images on the photosensitive drums 12K to 12C are primarily transferred to the intermediate transfer belt 10.

A secondary transfer roller 26 is located at a secondary transfer position where the intermediate transfer belt 10 is supported by the drive roller 22 suspending the belt 10, with the secondary transfer roller 26 facing the belt. At a secondary transfer position, a secondary transfer voltage of about +1,000 V is applied from the secondary transfer roller 26 through a paper sheet P, so that toner images on the intermediate transfer belt 10 are secondarily transferred to the paper sheet P. A belt cleaner 10*a* is provided in the downstream side of the secondary transfer roller 26 along the intermediate transfer belt 10.

In the image forming sections 11K to 11C, electrified chargers 13K to 13C as charging means, exposure positions 17K to 17C, developing devices 18K to 18C as developing means, primary transfer rollers 20K to 20C, and cleaning devices 21K to 21C as cleaning means are respectively arranged around the photosensitive drums 12K to 12C along rotation directions denoted representatively by an allow t.

The image forming sections 11K to 11C can be drawn out from the front side (toward an operator) of the body of the color copier 1. Each of drive systems for the photosensitive drums 12K to 12C, electric chargers 13K to 13C, exposure positions 17K to 17C, and developing devices 18K to 18C is located in the rear side of the body (in the side opposed to the operator).

At the exposure positions 17K to 17C, latent images are formed on the photosensitive drums 12K to 12C by laser beams 80K to 80C for respective colors, based on image data from the scanner section 2 or the like. The laser beams 80K to 80C are emitted from a laser exposure device 16, that is an exposure means, provided below the image forming sections 11K to 1C. Each of the electric chargers 13K to 13C in the image forming sections 11K to 11C uniformly charges the surfaces of the photosensitive drums 12K to 12C to about, for example, −700 V. The developing devices 18K to 18C respectively supply two-component developers for the photosensitive drums 12K to 12C by developing rollers 60K to 60C as developing members which are applied with a developing bias of about −500 V. The two-component developers contain toner of black (K), yellow (Y), magenta (M), and cyan (C), respectively, and a carrier.

The cleaning devices 21K to 21C remove residual toner from the surfaces of the photosensitive drums 12K to 12C by cleaning blades 70K to 70C. The laser exposure device 16 scans, with laser beams emitted from a semiconductor laser element, the photosensitive drums 12K to 12C in their own axial directions by using a polygon mirror 16*a*. Images are accordingly formed on the photosensitive drums 12K to 12C by an imaging lens system 16*b* and mirrors 81. Cover glasses 82K to 82C are provided at beam emission sections for the laser beams 80K to 80C for respective colors in the laser exposure device 16.

Below the laser exposure device 16, the color image forming apparatus 1 has first and second sheet feed cassette devices 27 and 28 for supplying paper sheets P in a direction toward the secondary transfer roller 26. On the right side of the color image forming apparatus 1, a manual feed tray 30 to allow manual feed of paper sheets P is arranged. On the part from the first and second sheet feed cassette devices 27 and 28 to the secondary transfer roller 26, there are provided pickup rollers 27*a* and 28*a* for picking up paper sheets P in the sheet feed cassette devices 27 and 28, separation rollers 27*b* and 28*b*, first and second conveyor rollers 31 and 32, and resist rollers 33. On the part from the manual feed tray 30 to the resist rollers 33, there are provided a pickup roller 30*a* for picking up paper sheets P, and a manual sheet feed roller 36.

A fixing device 38 is provided in the downstream side of the secondary transfer roller 26 along a vertical path 37 for conveying paper sheets P fed from the sheet feed cassette 27, 28 or the manual feed tray 30.

On an upper surface of the sheet delivery section 3, a reverse area 40 as a reverse section is provided substantially parallel to the sheet delivery section 3. A sheet delivery roller is provided on a sheet delivery conveyor path 41 from the fixing device 38 to the sheet delivery section 3. A reverse conveyor unit 45 between the fixing device 38 and the reverse area 40 includes a reverse conveyor path 46 and switchback rollers 45*a*.

Reverse guides 46*a* and 46*b* and a gate 47 are provided on the reverse conveyor path 46. The switchback rollers 45*a* are provided at an entrance of the reverse area 40 and are rotated in regular rotation directions so as to convey a paper sheet P to the reverse area 40 and in reverse rotation directions so as to convey a paper sheet P toward a re-conveyor unit 48 from the reverse area 40. The gate 47 guides the paper sheet P from the reverse area 40 toward the re-conveyor unit 48. The re-conveyor unit 48 has re-conveyor guides 50*a* and 50*b* and re-conveyor rollers 51 for guiding the paper sheet P in a direction to the secondary transfer roller 26.

Figure 2:
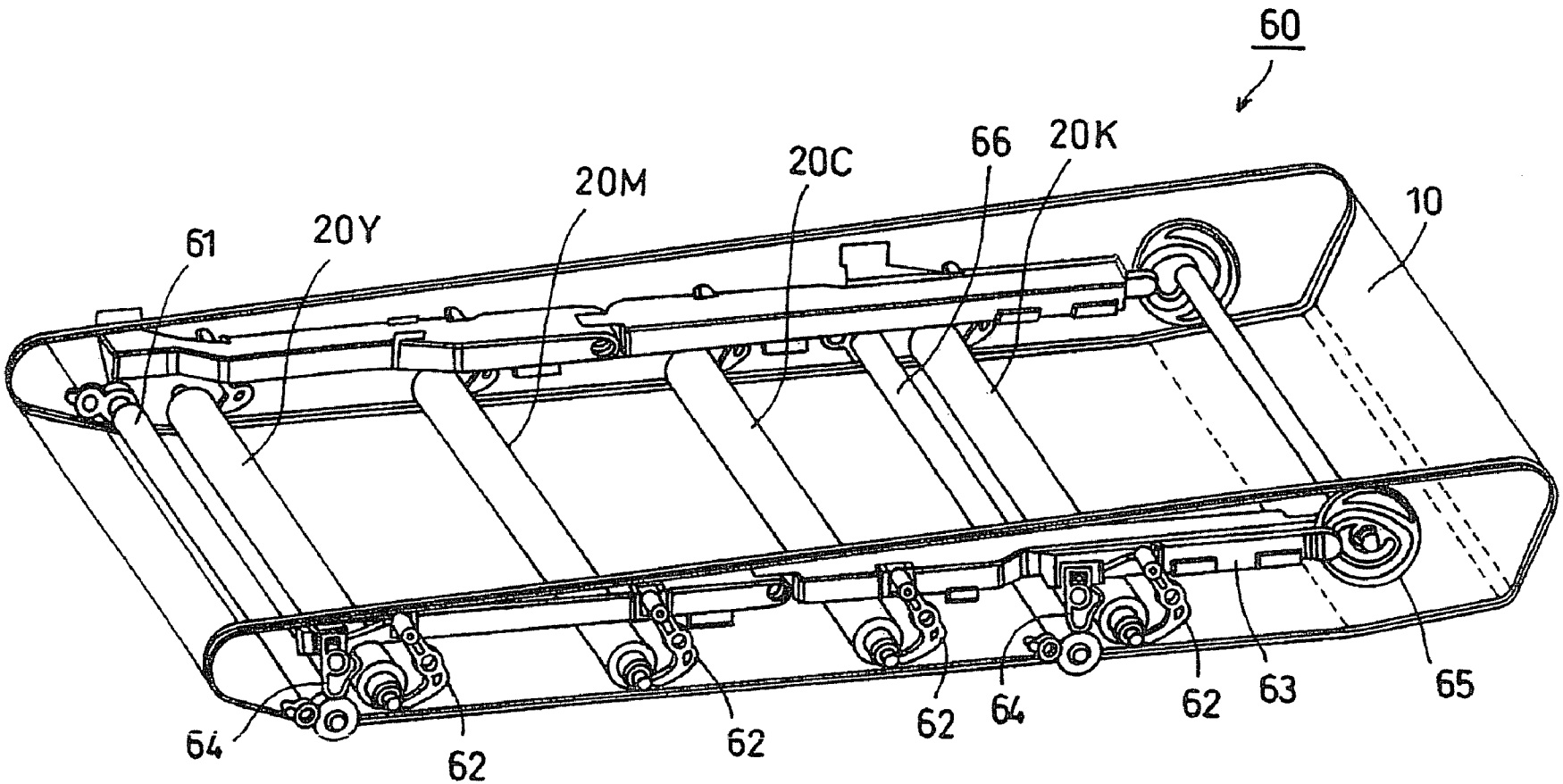
FIG. 2 is a perspective view showing a schematic structure of an intermediate transfer belt unit, viewed from a front side.

FIG. 2 is a perspective view showing a schematic structure of an intermediate transfer belt unit 60 from a front side thereof. In the rear side, the intermediate transfer belt unit 60 has the same structure as in the front side. In the intermediate transfer belt unit 60 as shown in FIG. 2, primary transfer rollers 20Y, 20M, 20C, and 20K are provided in this order from the front side to the rear side inside the intermediate transfer belt 10. A first contact/separation roller 61 and a second contact/separation roller 66 are respectively provided near the primary transfer roller 20Y and the primary transfer roller 20K in this order from the front side to the rear side. Ends of an axle of the primary transfer rollers 20Y, 20M, 20C, and 20K are engaged on one ends of primary transfer roller contact/separation levers 62. The other ends of the primary transfer roller contact/separation levers 62 are pivoted swingably on contact/separation links 63 which are provided on lateral sides inside the intermediate transfer belt 10, extending in suspending directions of the belt. Ends of belt contact/separation levers 64 are engaged on ends of an axle of an intermediate transfer belt contact/separation roller 61. The other ends of the belt contact/separation levers 64 are attached to one end of the contact/separation links 63.

The primary transfer roller contact/separation levers 62 swing in accordance with motion of the contact/separation links 63. The other ends of the contact/separation links 63 are attached to and engaged in grooves formed in contact/separation cams 65. The contact/separation cams 65 each are a so-called grooved cam. Each of two surfaces of the contact/separation cam 65 is formed to have a predetermined grooved cam shape.

In the present embodiment, the primary transfer rollers and intermediate transfer belt contact/separation rollers are grouped into two groups as follows, and the groups of rollers are driven independently from each other. That is, the primary transfer roller for K and the second contact/separation roller 66 constitute a group (hereinafter, referred to as a K group), as well as the primary transfer rollers for C, M, and Y and the first contact/separation roller 61 constitute another group (hereinafter, referred to as a CMY group). Hence, two independent link mechanisms respectively for the two groups are driven independently by forming shapes of grooved cams in two surfaces of one cam.

The contact/separation cams 65 are rotated by a drive unit not shown, which is constituted by a motor and a gear mechanism. Therefore, the contact/separation links 63 reciprocates in lateral directions of FIG. 2 in accordance with rotating motion of the contact/separation cams 65.

As described above, in this embodiment, the whole intermediate transfer belt unit is not moved so as to move into contact with and apart from drums but a mechanism for moving the primary transfer rollers and the intermediate transfer belt 10 into contact with and apart from the drums is employed. Therefore, the intermediate transfer belt 10 and the primary transfer rollers can be moved into contact with and apart from the drums by driving only required components without moving the whole unit.

Next, operation of the mechanism mentioned above will be described in detail below.

Figure 3:
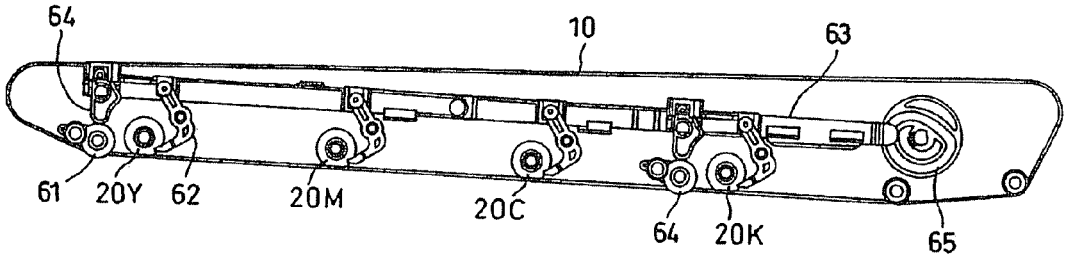
FIG. 3 shows a position of the intermediate transfer belt unit in a full-color mode.

Three positions are prepared for contact/separation of the intermediate transfer belt unit 60 which respectively correspond to three kinds of modes, i.e., a full-color mode, a monochrome mode, and a full separation mode. FIG. 3 shows a state in the full-color mode, FIG. 4 in the monochrome mode, as well as FIG. 5 in the full separation mode.

In the full-color mode shown in FIG. 3, all the primary transfer rollers 20Y, 20M, 20C, and 20K and the intermediate transfer belt 10 are in contact with the transfer drums, and two of the intermediate transfer belt contact/separation rollers are positioned below.

Figure 4:
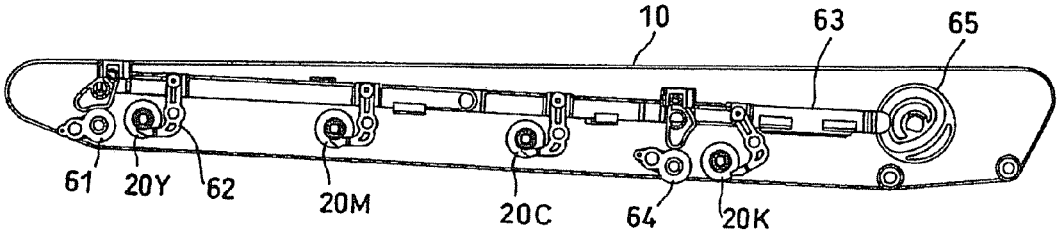
FIG. 4 shows a position of the intermediate transfer belt unit in a monochrome mode.

In the monochrome mode shown in FIG. 4, only the primary transfer roller 20K and the intermediate transfer belt 10 are in contact with the transfer drums, and the other primary transfer rollers 20C, 20M, and 20Y are positioned apart from the drums. In addition, the position of the intermediate transfer belt contact/separation roller near the primary transfer roller 20K is lowered, and the position of the intermediate transfer belt contact/separation roller near the primary transfer roller 20Y is raised.

Figure 5:
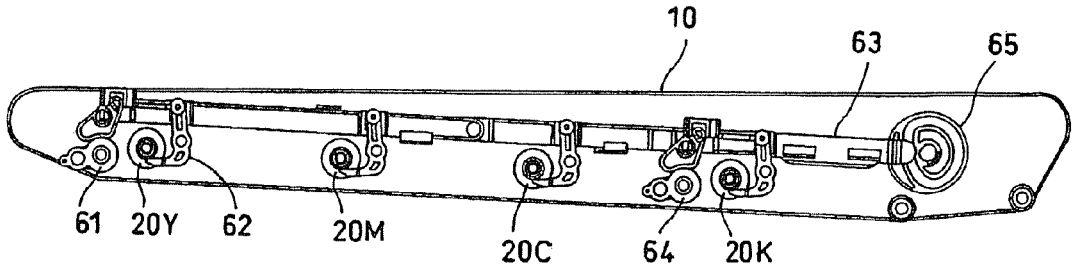
FIG. 5 shows a position of the intermediate transfer belt unit in a full separation mode.

In the full separation mode shown in FIG. 5, all the primary transfer rollers 20Y, 20M, 20C, and 20K are apart from the intermediate transfer belt 10 and the transfer drums.

Thus, depending on the modes, the primary transfer roller 20K and the second contact/separation roller 64 operate in different manners from the primary transfer rollers 20C, 20M, and 20Y and the first contact/separation roller 61.

Figure 6:
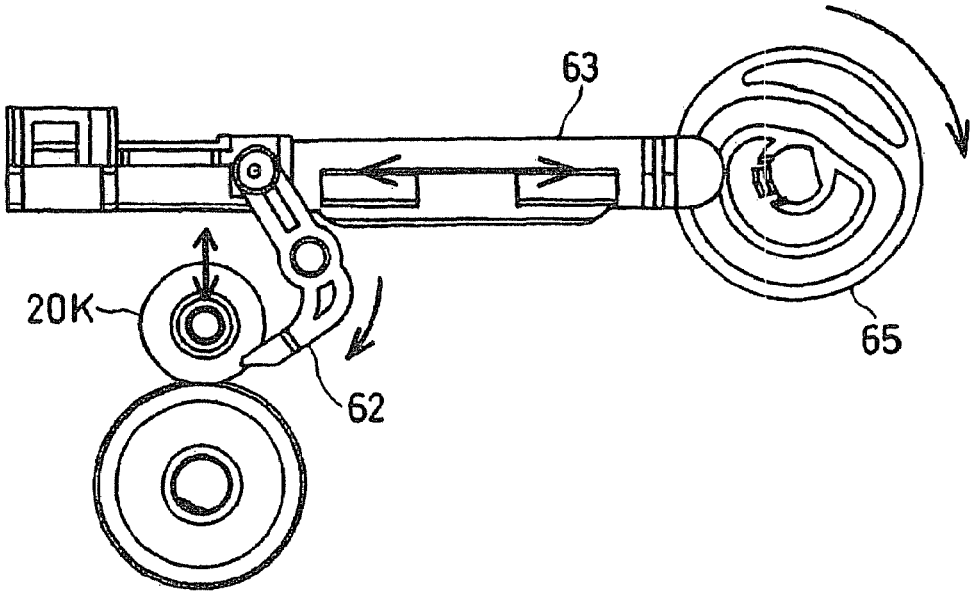
FIG. 6 shows motion of a link and a lever which is caused by a grooved cam according to the embodiment.

FIG. 6 depicts motion of a cam, link, and a lever. Each primary transfer roller is moved into contact with and apart from the intermediate transfer belt and a transfer drum as follows. As the contact/separation cams 65 rotate, the contact/separation links 63 reciprocate because one ends of the contact/separation links 63 are engaged in grooves formed in the contact/separation cams 65. As the contact/separation links 63 reciprocate, the primary transfer roller contact/separation levers swing thereby moving the primary transfer roller and the belt contact/separation roller into contact with and apart from the intermediate transfer belt 10 and the transfer drum.

Figure 7:
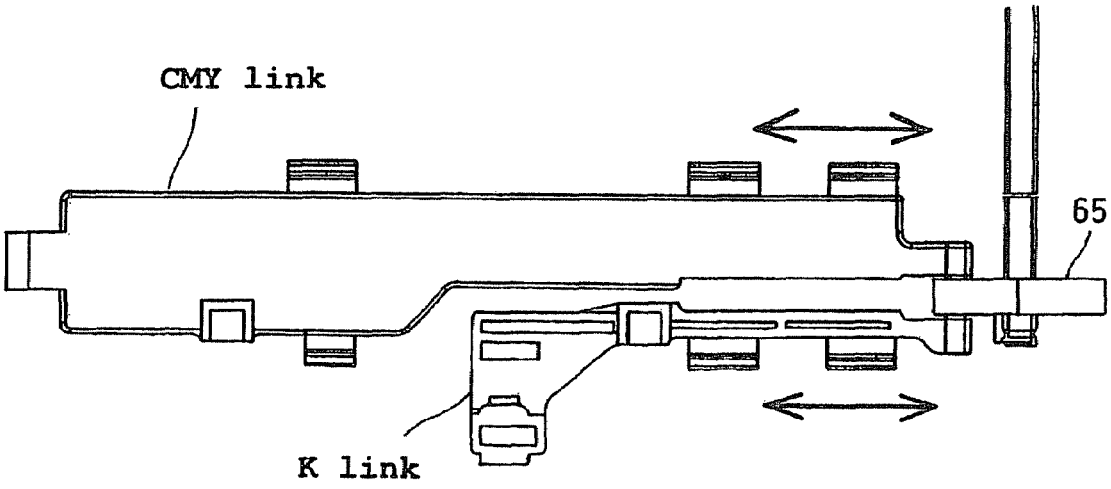
FIG. 7 schematically shows a structure of grooved cams and link mechanisms, viewed from the top.

FIG. 7 schematically shows a structure of a grooved cam and a link mechanism, viewed from the top. Although FIG. 7 shows only the front side, the same structure as in the front side is applied to the rear side. As the grooved cam 65 rotates, the link for the CMY group and the link for the K group reciprocate independently from each other.

Figure 8A:
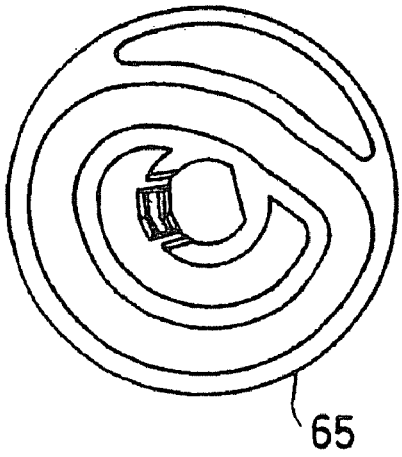
FIG. 8A and FIG. 8B show examples of shapes of grooves in the grooved cams.
Figure 8B:
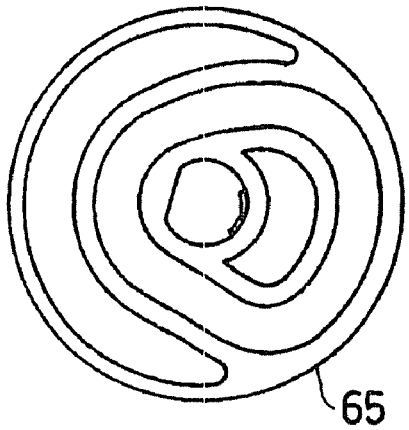

FIG. 8 shows examples of shapes of grooves formed in the grooved cams. FIG. 8A shows a cam shape for the K group as well as FIG. 8B for the CMY group. Since the cam shapes are determined to be matched with motion of the links for the K and CMY groups, independent driving of individual groups can be achieved. In the center of each grooved cam 65, a hole is formed so as to engage the cam on a drive shaft.

As shown in FIG. 6, the contact/separation links 63 are moved toward the right side in the figure as well as toward the left side by the grooved cams 65, on outer sides of the grooved cams 65 in accordance with rotation of the grooved cams 65. Upward and downward swinging of the primary transfer roller contact/separation levers 62 having one ends engaged with the contact/separation links 63 is controlled by reciprocation of the contact/separation links 63.

Therefore, impact which is caused by contact/separation of the primary transfer rollers can be smoothened. When separating the primary transfer rollers, impact between the primary transfer rollers and the primary transfer roller contact/separation levers can be relaxed. When moving the primary transfer rollers so as to make contact, impact between the primary transfer rollers and the transfer drums can be relaxed. That is, for example, impetuous motion caused by falls of each primary transfer roller due to dead load can be constrained more effectively, compared with a case of controlling motion of the primary transfer rollers and by use of plate cams. Accordingly, speeds of the primary transfer rollers can be controlled appropriatedly.

In general, a cam has features:

i A pressure angle (load) decreases as an operating rotation angle (an index angle) increases; and ii The pressure angle (load) decreases as an effective cam radius increases.

The index angle refers to a rotation angle to which a cam should reach until displacement of a follower is completed one time. Therefore, if the index angle is small, displacement is completed in a short time. If the index angle is large, the cam requires a long time to complete displacement.

Therefore, as shown in FIG. 6, when lifting up a primary transfer roller against the dead load of the roller and against a downward load applied by pressure springs or the like, links move rightward. In this case, an outer circumferential part of the groove of each grooved cam which effectively works against the loads is used. If the loads to be applied are small, e.g., if a primary transfer roller is lowered, the links move leftward. In this case, an inner circumferential part of the groove cam is used. Accordingly, the loads can be reduced, and the motor for driving the grooved cams can be downsized. Thus, loads to the motor can be reduced.

Figure 9:
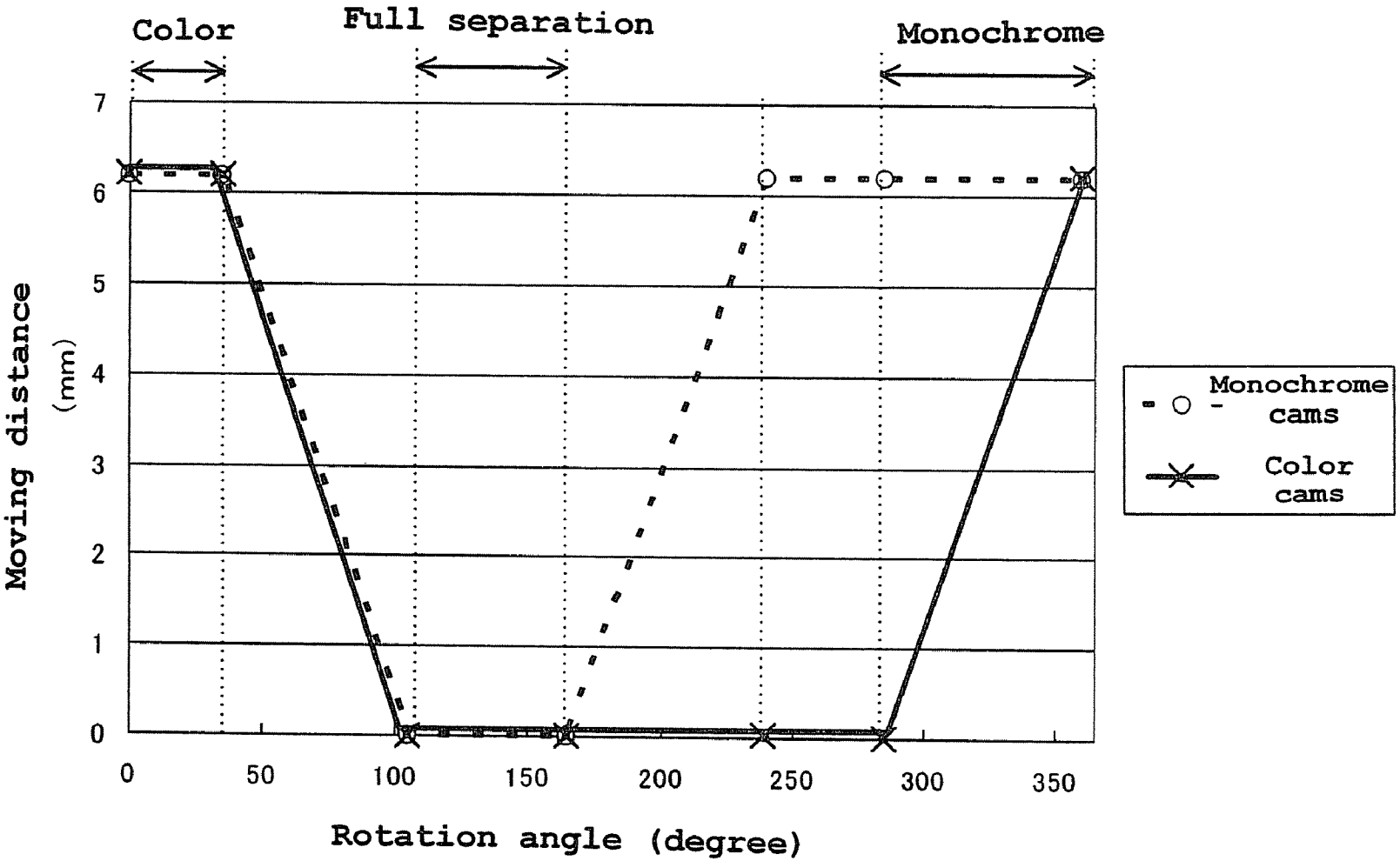
FIG. 9 is a timing chart showing operation of the grooved cams.

The order of cycling the three positions described above can be set to an order of the full-color mode to the full separation mode to the monochrome mode. FIG. 9 is a timing chart showing motion of the grooved cams in this case. The horizontal axis represents the rotation angle of the cams, and the vertical axis represents displacement, i.e., moving distances of primary transfer rollers and the like as followers. The horizontal axis is divided into dwell periods where moving distances stay unchanged and index periods where moving distances change. A starting position of an index period (i.e., a rotation angle at which followers start displacement) and an end position of the index period (i.e., a rotation angle at which the followers finish displacement) are plotted on the horizontal axis.

In case of the full-color mode, all the primary transfer rollers and the intermediate transfer belt are in contact with transfer drums. In the example of FIG. 9, cams for color printing create a maximum moving distance (displacement) of, for example, 6.3 mm or so at a rotation angle 0° where the rollers and belt are in contact with the drums. When the moving distance (displacement) is zero, the rollers and belt are apart from the drums. Outer sides of the grooved cams are used for transition from a contact state to a separate state. In the example of FIG. 9, cams for color printing start reducing the moving distance from a predetermined index start position, and the rollers and belt are made apart from the transfer drums at a rotation angle of approximately 105° as an end position of an index period.

The index angle of each cam is limited to 360° at most. However, since a dwell state is required in each mode, the extent of the assigned angle of each cam should be considered to be 120° or so. Hence, in the example of FIG. 9, the index angle is set to, for example, 72°. For monochrome printing, the cams also work at the same timing as for the color printing until the index period for separation ends (or is completed). The cams for both the monochrome printing and the color printing are in a separate state, the full separation mode is established.

In case of transition to the monochrome mode, the transition needs to go through the full separation mode. Inner sides of the grooved cams are used for transition from the full separation mode to a contact state in the monochrome mode. In the example of FIG. 9, the cams for monochrome printing take as an index start position a predetermined rotation angle during separation, e.g., an index angle set to 72°. Then, an index end point (a position where contact is completed) is set.

In case of transition to a color mode from a monochrome mode, the cams for color printing transits to a contact state through a dwell period where a separate state continues. The inner sides of the grooved cams are used for transition from the separate state to the contact state. In the example of FIG. 9, the index end position is set to 360° and the index angle is set to 72°. Then, an index start position for the contact state is set. The contact state of the cams for monochrome printing continues while the cams for color printing is transiting to the contact state.

Thus, in case of the order of the full-color mode to the full separation mode to the monochrome mode, the full separation mode is arranged after the full-color mode, and four primary transfer rollers therefore need to be separated (lifted up) to transit to a full separate state. In addition, as shown in FIG. 9, index angles are set to be equal for both the outer and inner sides of the grooved cams. As a result, loads cannot be reduced.

From the transition of modes in the order of the full-color mode to the full separation mode to the monochrome mode, as shown in FIG. 9, it is understood that loads to the motor for driving the grooved cams are heavy.

Figure 10:
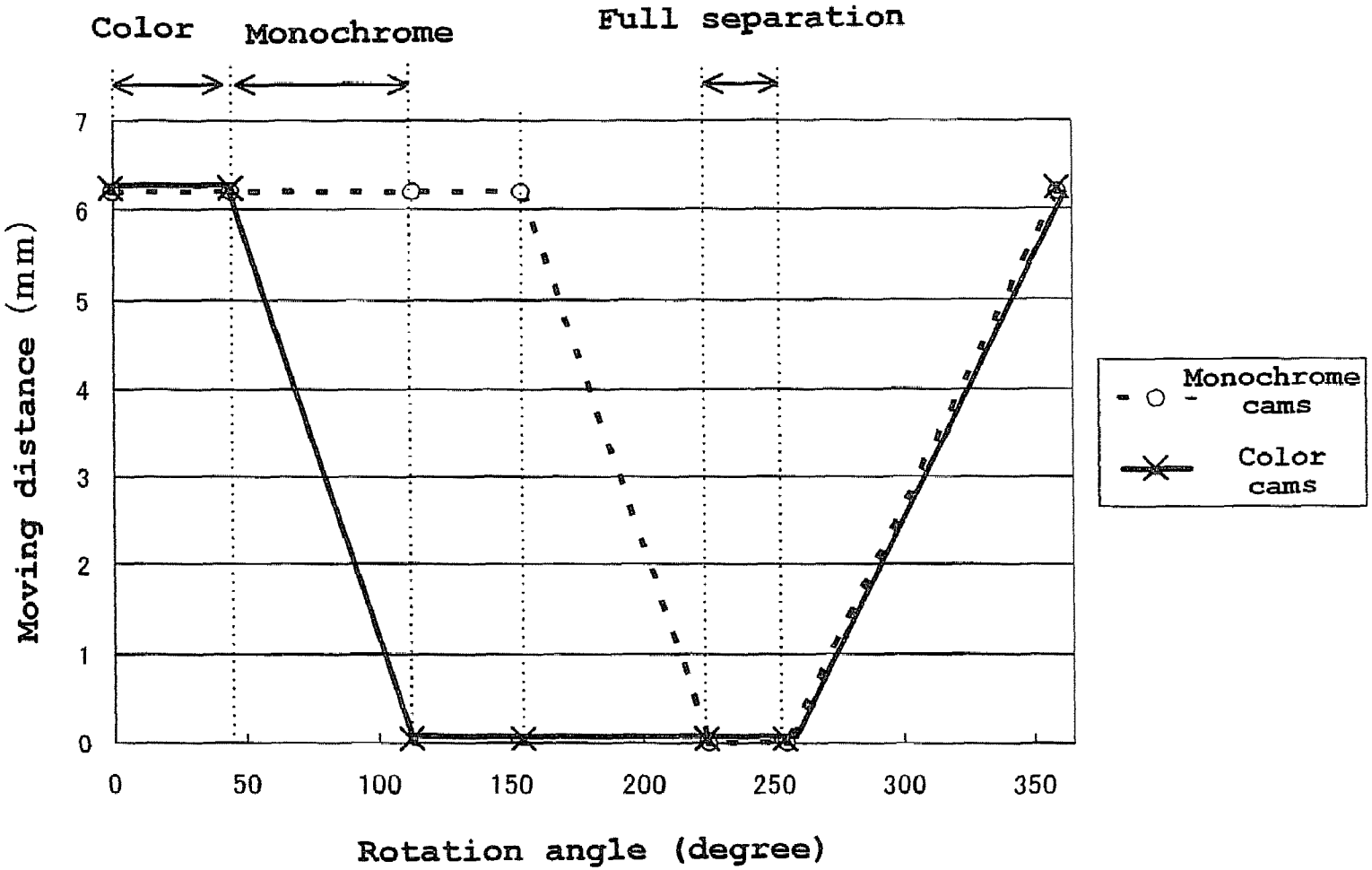
FIG. 10 is a timing chart showing operation of the grooved cams.

Hence, in this embodiment, the order of cycle of the three positions is set to an order of the full-color mode to the monochrome mode to the full separation mode. FIG. 10 is a timing chart of the grooved cams in this case. In the full-color mode, all the primary transfer rollers and the intermediate transfer belt are in contact with transfer drums, and the outer sides of the grooved cams are used for transition from a contact state to a separate state. In the example of FIG. 10, the cams for color printing attain the maximum moving distance (displacement) at the rotation angle 0°, so that the cams are in the contact state. The cams for color printing transit to a separate state through a dwell period where the contact state continues. In the example shown in FIG. 10, an index angle is set to 72°. Then, an index start position is set. Upon completion of a index period (upon completion of separation in this case), the separate state is continued until the full separation mode ends. The inner sides of the grooved cams are used for transition from the separate state to the contact state. In the example shown in FIG. 10, an index angle is set to 102°. Then, an index start position is set.

In this case, the monochrome mode is arranged after the full-color mode as shown in FIG. 10. Therefore, only three primary transfer rollers need to be lifted and separated in order to transit from the full-color mode to the monochrome mode. The cams for monochrome printing are in a contact state naturally in the full-color mode and even in the monochrome mode. That is, when the cams for color printing start transiting from a contact state to a separate state, the monochrome mode starts.

Loads from the four primary transfer rollers in the example shown in FIG. 9 are obviously different from loads from the three primary transfer rollers shown in FIG. 10. Accordingly, loads can be reduced and the motor for driving the grooved cams can be downsized. As a result, loads to the motor can be reduced.

In addition, in this embodiment, the index angle is set to be small in case of using outer circumferential parts. Increase in loads caused by such a small index angle is reduced to the minimum by using a large radius for the outer circumferential parts. Further, the pressure angle is set to be large in case of using inner circumferential parts having a small radius.

Increase in loads caused by such a small radius is reduced to the minimum by using a large pressure angle.

Transition from the monochrome mode to the full separation mode is set as follows. While the cams for color printing stay in a separate state, the cams for monochrome printing start indexing toward the separate state at a predetermined rotation angle. Indexing is finished after an index period. In the example of FIG. 10, the index angle is set to, for example, 72°, and outer sides of the grooved cams are used for transition from the contact state to the separate state.

The cams for both the color printing and monochrome mode are all separated in the separate state. Transition from the full separation mode to the full-color mode is set as follows. That is, the cams for color printing and monochrome printing are caused to start indexing toward the contact state at a predetermined rotation angle and finish indexing at a rotation angle of 360° through an index period. In the example of FIG. 10, the index angle is set to, for example, 102°, and inner sides of the grooved cams are used for transition from the separate state to the contact state.

If a large index angle is assigned in the example of FIG. 9 in case of using the inner sides of the cams, it is understood that two indices need to be assigned. In contrast, in the example shown in FIG. 10, only one index is needed. Further, it is desirable that a dwell period in FIG. 9 is slightly reduced, and the dwell period is increased when using the inner sides.

According to the embodiment as described above, the contact/separation mechanism can be downsized. Swing of the primary transfer roller contact/separation levers can be controlled so as to follow the motion of the grooved cams. Accordingly, impact affected on the transfer drums from the primary transfer rollers when making contact with the drums can be relaxed gently. During separation, impact between the primary transfer rollers and the primary transfer roller contact/separation levers can be relaxed. Accordingly, lifetime of each component can be extended.

Although an exemplary embodiment of the present invention has been shown and described, it will be apparent to those having ordinary skill in the art that a number of changes, modifications, or alterations to the invention as described herein may be made, none of which depart from the spirit of the present invention. All such changes, modifications, and alterations should therefore be seen as within the scope of the present invention.

What is claimed is:

1. An image forming apparatus having an intermediate transfer member to which a toner image developed on a photosensitive material is transferred while the intermediate transfer member rotates plural times, and a transfer roller that is provided to be able to move into contact with and apart from the intermediate transfer member and transfers the toner image on the intermediate transfer member to a paper sheet while conveying the paper sheet pressed to the intermediate transfer member, the apparatus comprising:

a grooved cam having different grooves formed respectively in front and back surfaces of the grooved cam, wherein a link mechanism for color image printing and a link mechanism for monochrome printing are reciprocated independently from each other, with ends of the link mechanism engaged respectively in the grooves of the grooved cam, thereby to control contact and separation of the transfer roller and the intermediate transfer member, wherein each of the link mechanism includes:

a link member having one end engaged in one of the grooves of the grooved cam; and a lever member having one end pivoted, to be swingable, on the link member and the other end attached to an end of an axle of the transfer roller.

2. The image forming apparatus according to claim 1, wherein three modes of a full-color mode, monochrome mode, and full separation mode are available for moving the transfer roller into contact with and apart from the intermediate transfer member, and positions of the grooved cam corresponding respectively to the three modes can be switched repeatedly in order of the full-color mode to the monochrome mode to the full separation mode.

3. The image forming apparatus according to claim 2, wherein in the full-color mode, all transfer rollers and the intermediate transfer member are in contact with transfer drums;

in the monochrome mode, only one transfer roller for monochrome printing and the intermediate transfer member are in contact with one of the a transfer drums; and in the full separation mode, all the transfer rollers are separated from the intermediate transfer member and the transfer drums.

4. The image forming apparatus according to claim 1, wherein the link mechanisms and the grooved cam are positioned so as to generate a load which acts to raise the transfer roller if the link mechanisms are moved in a direction toward a position where the grooved cam is located.

5. The image forming apparatus according to claim 4, wherein if the transfer roller is raised, outer circumferential parts of the grooves of the grooved cam are used, and if the transfer roller is lowered, inner circumferential parts of the grooves of the grooved cam are used.

* * * * *